US010629975B1

(12) United States Patent
Aster

(10) Patent No.: US 10,629,975 B1
(45) Date of Patent: Apr. 21, 2020

(54) SYSTEMS AND METHODS FOR COMBINING OR DIVIDING MICROWAVE POWER USING NON-SLOTTED CONDUCTORS

(71) Applicant: David B. Aster, Spokane Valley, WA (US)

(72) Inventor: David B. Aster, Spokane Valley, WA (US)

( * ) Notice: Subject to any disclaimer, the term of this patent is extended or adjusted under 35 U.S.C. 154(b) by 0 days.

(21) Appl. No.: 16/295,804

(22) Filed: Mar. 7, 2019

Related U.S. Application Data

(63) Continuation of application No. 16/016,457, filed on Jun. 22, 2018, now Pat. No. 10,276,906, which is a continuation-in-part of application No. 15/923,515, filed on Mar. 16, 2018, now Pat. No. 10,312,565, which is a continuation-in-part of application No. 15/582,533, filed on Apr. 28, 2017, now Pat. No. 9,947,986, which is a continuation-in-part of application No. 15/043,570, filed on Feb. 14, 2016, now Pat. No. 9,673,503, and a continuation-in-part of application No. 15/078,086, filed on Mar. 23, 2016, (Continued)

(51) Int. Cl.

| | |
|---|---|
| ***H01P 1/30*** | (2006.01) |
| ***H01P 1/213*** | (2006.01) |
| ***H01P 11/00*** | (2006.01) |
| ***H01P 3/06*** | (2006.01) |

(52) U.S. Cl.
CPC ..... *H01P 1/30* (2013.01); *H01P 1/2133* (2013.01); *H01P 3/06* (2013.01); *H01P 11/005* (2013.01); *H01P 11/007* (2013.01)

(58) Field of Classification Search
CPC .. H01P 1/20; H01P 1/2133; H01P 3/06; H01P 11/005; H01P 11/007
See application file for complete search history.

(56) References Cited

U.S. PATENT DOCUMENTS

| | | | |
|---|---|---|---|
| 2,946,965 | A | 7/1960 | Albanese |
| 3,931,587 | A | 1/1976 | Harp et al. |

(Continued)

OTHER PUBLICATIONS

Kenneth J. Russell, 'Microwave power combining techniques,' IEEE Transactions on Microwave Theory and Techniques, May 1979, pp. 472-478.

(Continued)

*Primary Examiner* — Robert J Pascal
*Assistant Examiner* — Kimberly E Glenn
(74) *Attorney, Agent, or Firm* — Malhotra Law Firm, PLLC; Deepak Malhotra

(57) ABSTRACT

A power divider/combiner has a main conductor defining an axis; an input connector having a center conductor, adapted to be coupled to a signal source, electrically coupled to the main conductor and having an axis coincident with the main conductor axis, and having a second conductor electrically coupled to a ground conductor; a cylinder conductor including an inner cylindrical surface radially exterior of and spaced apart from the main conductor, including an outer cylindrical surface, and having a cylinder axis coincident with the main conductor axis; and a plurality of output connectors, the output connectors having center conductors electrically coupled to the cylinder conductor and having respective second conductors electrically coupled to a second ground conductor. Methods are also disclosed.

20 Claims, 9 Drawing Sheets

Related U.S. Application Data now Pat. No. 9,793,591, said application No. 15/923,515 is a continuation-in-part of application No. 15/614,572, filed on Jun. 5, 2017, now Pat. No. 9,960,469, which is a continuation-in-part of application No. 15/043,570, filed on Feb. 14, 2016, now Pat. No. 9,673,503, and a continuation-in-part of application No. 15/078,086, filed on Mar. 23, 2016, now Pat. No. 9,793,591.

(60) Provisional application No. 62/140,390, filed on Mar. 30, 2015.

(56) References Cited

U.S. PATENT DOCUMENTS

| | | | |
|---|---|---|---|
| 4,032,865 | A | 6/1977 | Harp et al. |
| 4,152,680 | A | 5/1979 | Harrison |
| 4,188,590 | A | 2/1980 | Harp et al. |
| 4,238,747 | A | 12/1980 | Harp et al. |
| 4,266,208 | A | 5/1981 | Cornish |
| 4,453,139 | A | 6/1984 | Labaar |
| 4,598,254 | A | 7/1986 | Saito et al. |
| 4,694,260 | A | 9/1987 | Argintaru et al. |
| 4,700,145 | A | 10/1987 | Yelland |
| 4,835,496 | A | 5/1989 | Schellenberg et al. |
| 5,142,253 | A | 8/1992 | Mallavarpu |
| 5,389,890 | A | 2/1995 | Burrage |
| 5,644,272 | A | 7/1997 | Dabrowski |
| 5,777,527 | A | 7/1998 | Sanders |
| 5,784,033 | A | 7/1998 | Boldissar, Jr. |
| 5,847,625 | A | 12/1998 | Gillette |
| 6,005,450 | A | 12/1999 | Schmidt et al. |
| 6,018,277 | A | 1/2000 | Vaisanen |
| 6,919,776 | B1 | 7/2005 | Mobius et al. |
| 7,102,459 | B1 | 9/2006 | Arnold et al. |
| 7,215,218 | B2 | 5/2007 | Burns et al. |
| 7,397,328 | B2 | 7/2008 | Yasuda et al. |
| 7,468,640 | B2 | 12/2008 | Nosaka |
| 7,479,850 | B2 | 1/2009 | Kearns et al. |
| 8,508,313 | B1 | 8/2013 | Aster |
| 9,065,163 | B1 | 6/2015 | Wu |
| 2013/0335162 | A1 | 12/2013 | Sun |

OTHER PUBLICATIONS

Clayton R. Paul, Analysis of Multiconductor Transmission Lines, John Wiley & Sons, New York, New York, 1994, pp. 219-222.

G. C. Temes and S. K. Mitra, Modern Filter Theory and Design, John Wiley & Sons, New York, New York, 1973, pp. 276-284.

G. Matthaei, L. Young, E.M.T. Jones, Microwave Filters, Impedance-matching Networks, and Coupling Structures, Artech House Books, Dedham, MA, pp. 585-595.

G. C. Temes and S. K. Mitra, Modern Filter Theory and Design, John Wiley & Sons, New York, New York, pp. 306-308, 1973.

G. Matthaei, L. Young, E.M.T. Jones, Microwave Filters, Impedance-matching Networks, and Coupling Structures, Artech House Books, Dedham, MA, pp. 595-599.

"Choosing the Best Power Divider for the Task of Signal Combining" retrieved from: http://www.microlab.fxr.com/resource-library?brand=Microlab&go=application_notes, downloaded and printed on Feb. 6, 2016 (6 pages).

"Reactive vs. Wilkinson Splitters" retrieved from: http://www.microlab.fxr.com/resource-library?brand=Microlab&go=application_notes, downloaded and printed on Feb. 6, 2016 (2 pages).

"Dividers & Combiners" retrieved from: http://www.microlab.fxr.com/resource-library?brand=Microlab&go=application_notes, downloaded and printed on Feb. 6, 2016 (4 pages).

G. Matthaei, L. Young, E.M.T. Jones, Microwave Filters, Impedance-matching Networks, and Coupling Structures, Artech House Books, Dedham, MA, p. 220.

Wilkinson, Ernest J., An N-Way Hybrid Power Divider, Jan. 1960, pp. 116-118, IRE Transactions on Microwave Theory and Techniques.

Horton, M.G., and Wenzel, R.J., General Theory and Design of Optimum Quarter-Wave TEM Filters, May 1965, pp. 316-327, IEEE Transactions on Microwave Theory and Techniques.

First Office Action, dated Jul. 5, 2016, in U.S. Appl. No. 15/043,570, invented by the inventor hereof.

Second Office Action, dated Nov. 17, 2016, in U.S. Appl. No. 15/043,570, invented by the inventor hereof.

Electronics Research, Inc., Installation Instructions II2302, EIA Flange Adapters for Rigid Transmission Lines.

Matthaei, Young, and Jones, Microwave Filters, Impedance-Matching Networks, and Coupling Structures, 1980, p. 302, Artech House Books.

Patzelt and Arndt, Double-Plane Steps in Rectangular Waveguides and their Application for Transformers, Irises, and Filters, pp. 772-776, May 5, 1982, IEEE Transactions on Microwave Theory and Techniques.

Whinnery, Jamieson, and Robbins, Coaxial-Line Discontinuities, p. 695, Nov. 1944, Proceedings of the I.R.E.

Semi-Flexible Air Dielectric Coaxial Cables and Connectors, 50 Ohms, EIA Standard RS-258, Mar. 1962, Table 1 and pp. 5-6.

First Office Action, dated Jul. 11, 2017, in U.S. Appl. No. 15/493,591, invented by the inventor hereof.

First Office Action, dated Jul. 14, 2016, in U.S. Appl. No. 15/493,074, invented by the inventor hereof.

First Office Action, dated Jul. 20, 2017, in U.S. Appl. No. 15/078,086, invented by the inventor hereof.

First Office Action, dated Dec. 29, 2017, in U.S. Appl. No. 15/614,572, invented by the inventor hereof.

Wenzel, The Modern Network Theory Approach to Microwave Filter Design, IEEE Transactions on Electromagnetic Compatibility, pp. 196-209, Jun. 1, 1968, vol. EMC-10, No. 2.

Levy and Whiteley, Synthesis of Distributed Elliptic-Function Filters from Lumped-Constant Prototypes, IEEE Transactions on Microwave Theory and Techniques, pp. 506-517, Nov. 1966, vol. MTT-14, No. 11.

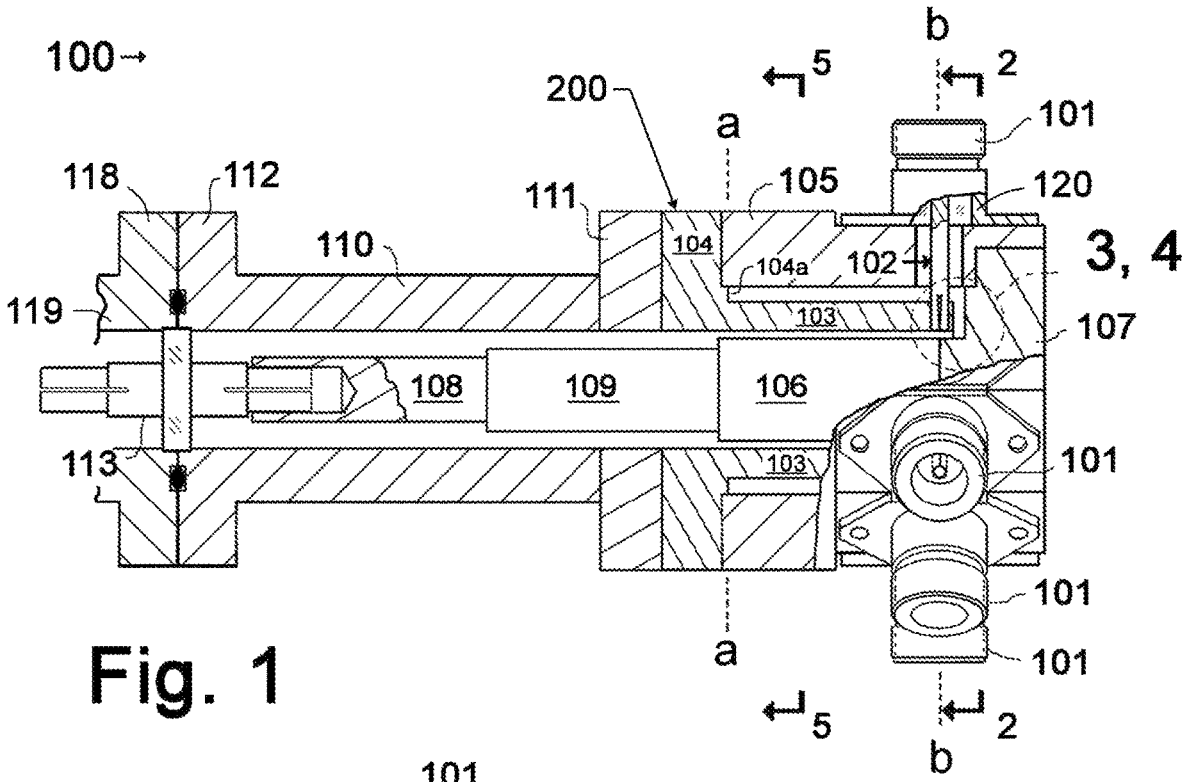
Fig. 1
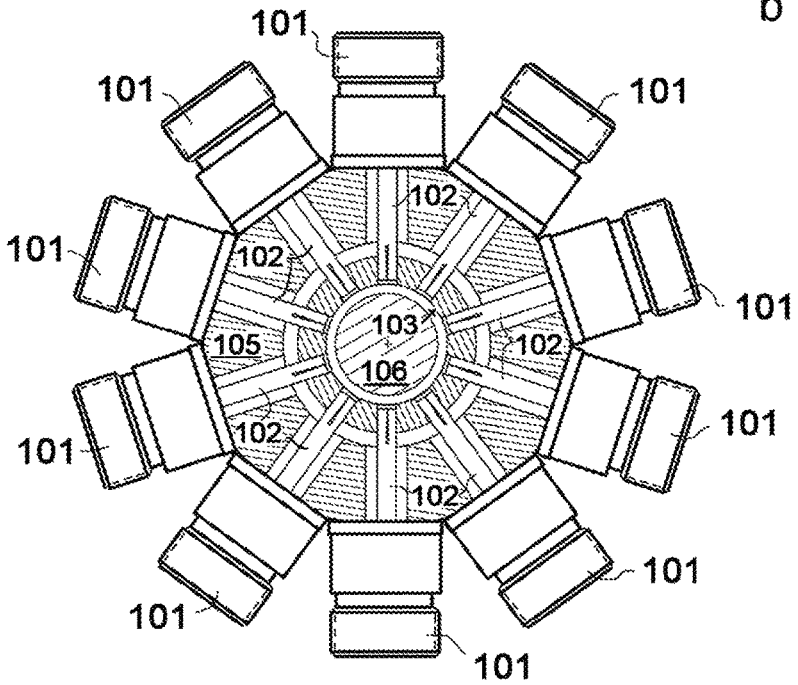
Fig. 2 Section 2 - 2

$$Z_3 = 60 \, \mathrm{Log}_e (b / a)$$

$$Z_{SH} = 60 \, \mathrm{Log}_e (d / c)$$

Section 5 - 5

$Z_S = Z_L = 50$ ohms
$Z_1 = 36.8$ ohms
$Z_2 = 19.1$ ohms
$Z_3 = 7.7$ ohms
$Z_{SH} = 7.1$ ohms
$Z_L/N = 5.0$ ohms

SYSTEMS AND METHODS FOR COMBINING OR DIVIDING MICROWAVE POWER USING NON-SLOTTED CONDUCTORS

CROSS REFERENCE TO RELATED APPLICATION

This is a continuation of U.S. patent application Ser. No. 16/016,457 filed Jun. 22, 2018, which is a continuation of U.S. patent application Ser. No. 15/923,515 filed Mar. 16, 2018, naming David B. Aster as inventor, which in turn is a continuation-in-part of U.S. patent application Ser. No. 15/582,533, filed Apr. 28, 2017 (now U.S. Pat. No. 9,947,986), which is a continuation-in-part of U.S. patent application Ser. No. 15/043,570, filed Feb. 14, 2016 (now U.S. Pat. No. 9,673,503) and a continuation-in-part of U.S. patent application Ser. No. 15/078,086, filed Mar. 23, 2016 (now U.S. Pat. No. 9,793,591), both of which (Ser. No. 15/043,570 and Ser. No. 15/078,086) in turn claim priority to U.S. Provisional Patent Application Ser. No. 62/140,390, filed Mar. 30, 2015, all of which were invented by the inventor hereof and all of which are incorporated herein by reference.

U.S. patent application Ser. No. 15/923,515 is also a continuation in part of U.S. patent application Ser. No. 15/614,572, filed Jun. 5, 2017, (now U.S. Pat. No. 9,960,469), which is a continuation-in-part of U.S. patent application Ser. No. 15/043,570, filed Feb. 14, 2016 (now U.S. Pat. No. 9,673,503), and a continuation-in-part of U.S. patent application Ser. No. 15/078,086, filed Mar. 23, 2016 (now U.S. Pat. No. 9,793,591), both of which (Ser. No. 15/043,570 and Ser. No. 15/078,086) in turn claim priority to U.S. Provisional Patent Application Ser. No. 62/140,390, filed Mar. 30, 2015, all of which were invented by the inventor hereof and all of which are incorporated herein by reference.

TECHNICAL FIELD

The technical field includes methods and apparatus for summing (or combining) the power of a number of isolator-protected power sources or for dividing power into a number of separate divided output signals.

SUMMARY

Some embodiments provide a power divider (or combiner) including a main conductor defining an axis; an input (or output) connector having a center conductor, adapted to be coupled to a signal source, electrically coupled to the main conductor and having an axis coincident with the main conductor axis, and having a second conductor electrically coupled to a ground conductor; a cylinder conductor including an inner cylindrical surface radially exterior of and spaced apart from the main conductor, including an outer cylindrical surface, and having a cylinder axis coincident with the main conductor axis; and a plurality of output (or input) connectors, the output connectors having center conductors electrically coupled to the cylinder conductor and having respective second conductors electrically coupled to a second ground conductor.

Other embodiments provide a power divider/combiner including a main conductor defining an axis, and having a length along the axis, the main conductor having multiple different diameters along its length defining multiple portions; an input connector having a center conductor, adapted to be coupled to a signal source, electrically coupled to the main conductor and having an axis coincident with the main conductor axis, and having a second conductor, the input connector defining a first end of the divider/combiner, the divider/combiner having a second end axially spaced apart from the first end; a first ground conductor radially exterior of the main conductor and coupled to the second conductor of the input connector; an electrically and thermally conducting inner flange, axially between the first ground conductor and the second end, radially exterior of the main conductor, and having an inner surface and a face surface; an outer ground conductor axially between the inner flange and second end and having an inner surface; a cylinder conductor, having the general shape of a hollow cylinder, having an inner cylindrical surface and outer cylindrical surface, radially exterior of and radially spaced apart from one of the portions of the main conductor, having a cylinder axis coincident with the main conductor axis, and having a proximal end electrically connected to the inner flange and a distal end extending towards the second end; a plurality of output connectors having center conductors electrically coupled to the distal end of the cylinder conductor, via the outer cylindrical surface of the cylinder conductor, and having respective second conductors electrically coupled to the outer ground conductor; the outer ground conductor having an inner surface radially exterior of the outer cylindrical surface of the cylinder conductor; and an electrically and thermally conducting outer backplate at the second end electrically coupled to the main conductor and axially spaced apart from the distal end of the cylinder conductor by a gap.

Other embodiments provide a method of manufacturing a power divider/combiner, the method including providing a main conductor defining an axis; providing a coax input connector having a center conductor, adapted to be coupled to a signal source and having an axis coincident with the main conductor axis; electrically coupling the input connector to the main conductor; providing a hollow cylinder conductor radially exterior of and spaced apart from the main conductor, having a cylinder axis coincident with the main conductor axis, having an outer cylindrical surface; providing a plurality of coax output connectors having center conductors; providing an electrically and thermally conducting inner flange, radially exterior of the main conductor and having an inner surface and a face surface; electrically coupling the respective center conductors of the output connectors to the hollow cylinder conductor; and defining a passband filter between the input connector and the output connectors.

BRIEF DESCRIPTION OF THE VIEWS OF THE DRAWINGS

FIG. 1 is a side view of a divider/combiner in accordance with various embodiments, partly in section.

FIG. 2 is a sectional view taken along line 2-2 of FIG. 1.

DETAILED DESCRIPTION OF THE ILLUSTRATED EMBODIMENTS

Figure 3:
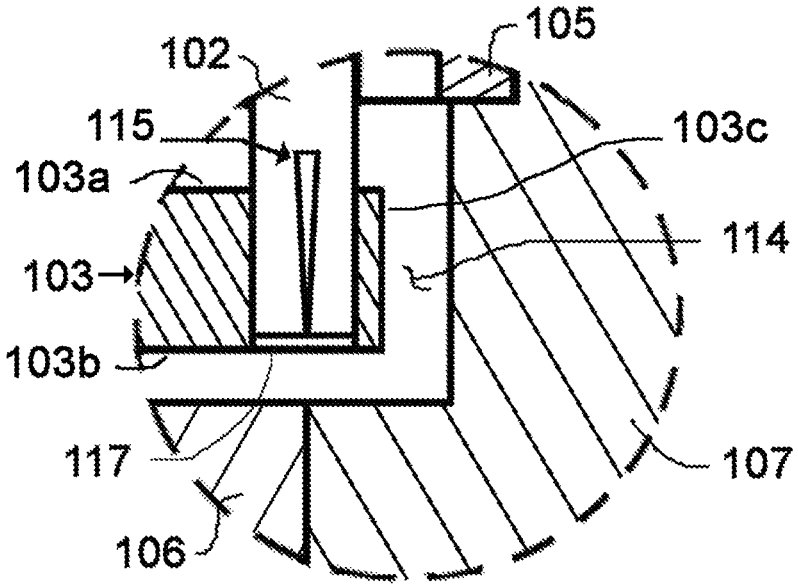
FIG. 3 is a partial cut-away view of the divider/combiner of FIG. 1.

Attention is directed to above-incorporated U.S. patent application Ser. No. 15/078,086, filed Mar. 23, 2016, now U.S. Pat. No. 9,793,591, from which this application claims priority.

FIG. 1 shows a microwave power divider 100, which can alternatively be used as a power combiner, in accordance with various embodiments. It will hereinafter be referred to as a power divider-combiner 100.

Hereinafter described as if for use as a power divider, the power divider-combiner 100 has (see FIGS. 1, 2, 6, and 9) a single main input port flange 112, a center conductor bullet 113, and a quantity N of output port connectors 101. It is to be understood that, for convenience, the terms "input" and "output", when used herein and in the claims, assume that the divider-combiner is being used as a power divider. The roles of the inputs and outputs are reversed when the divider-combiner is being used as a power combiner. In the illustrated embodiments, a 7/8 EIA (Electronic Industries Association) connector interface is defined by an input connector flange 118, an input ground conductor 119, and the input port flange 112 with the bullet 113; however, other sizes or connector types are possible. The power divider-combiner 100 further has (see FIG. 9 and FIGS. 1, 2) ten Type N (female) connectors for the output ports 101. In other embodiments, the input connector possibilities are 7-16 DIN, 4.1-9.5 DIN, Type N (female or male), TNC (female or male), or possibly larger EIA flange types. Other types of output and input RF connectors are possible.

Figure 4:
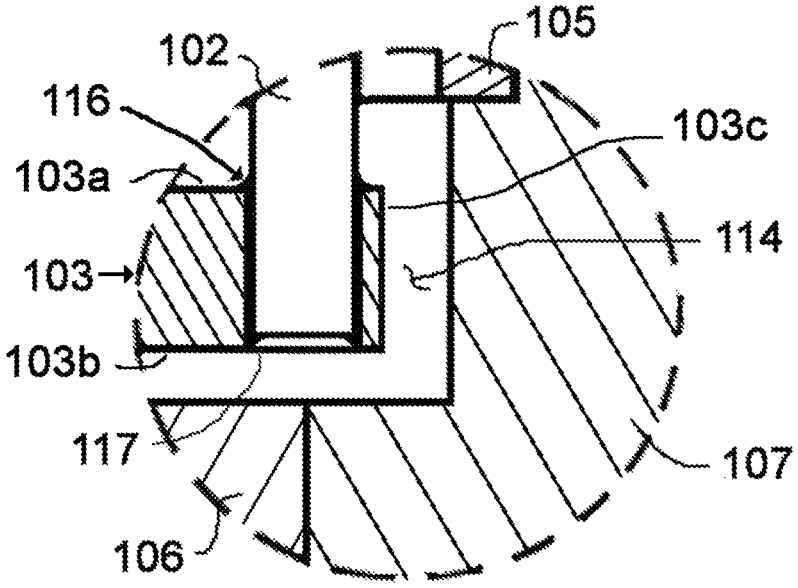
FIG. 4 is a partial cut-away view of the divider/combiner of FIG. 1 in accordance with alternative embodiments.
Figure 6:
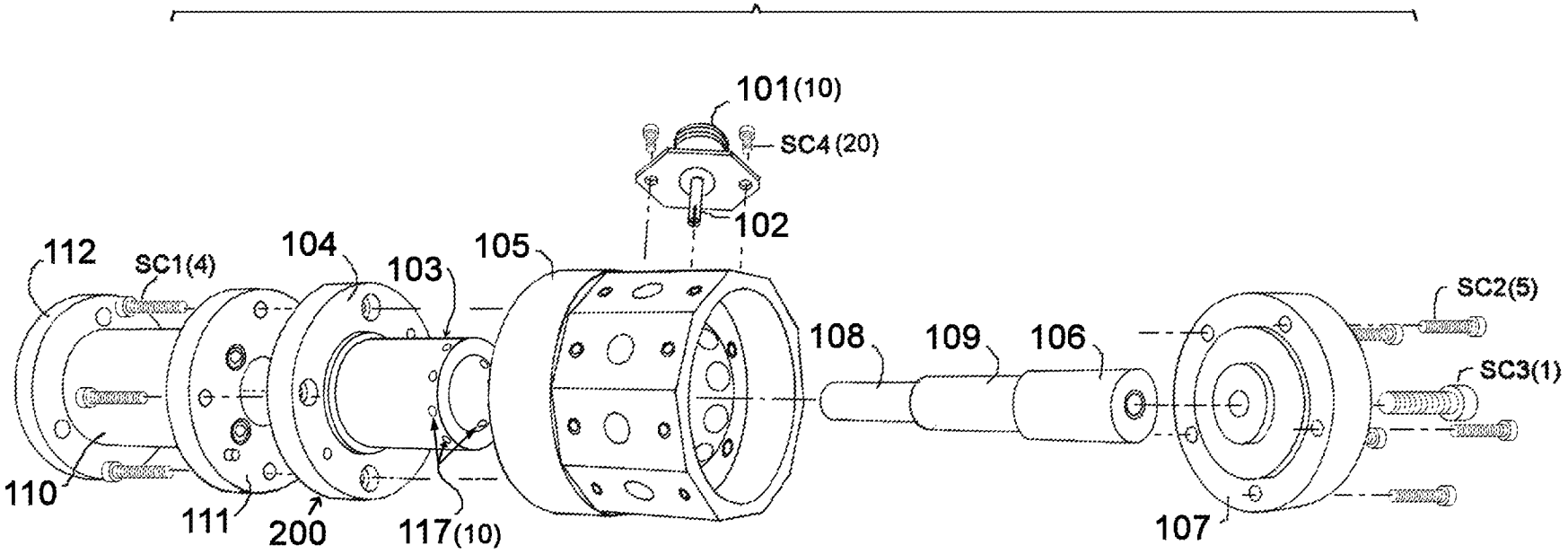
FIG. 6 is an exploded perspective view of the power divider/combiner of FIG. 1.
Figure 11:
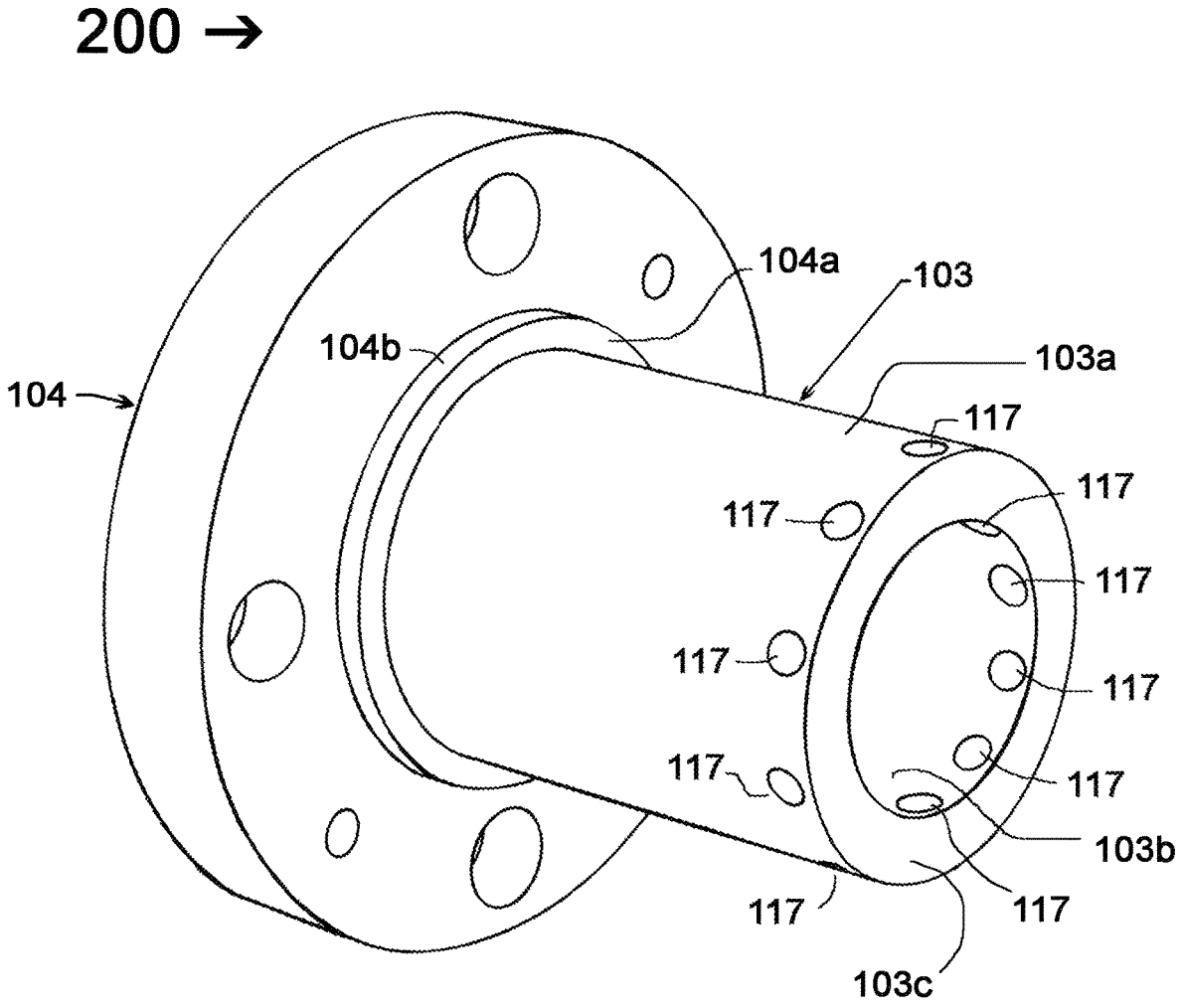
FIG. 11 is a perspective view of a conductor included in the divider/combiner of FIG. 1.

The power divider-combiner 100 includes a conductor 103 defining, in the illustrated embodiments, the shape of or in the general shape of a hollow cylinder (see FIGS. 6 and 11). Respective output RF connectors 101 have a center conductor 102 electrically connected with an outer end of the conductor 103. FIG. 3 shows center conductor 102 with a slotted end 115 distal from the output port 101 and compression fit into a receiving bore 117 located near an end of the conductor 103. FIG. 4 shows an alternative connection. In the embodiments of FIG. 4, the center conductor 102 is attached with solder or braze alloy 116 into the bore 117 to form the electrical and thermal connection to the conductor 103. The power divider-combiner 100 includes (see FIG. 1) a stepped diameter center conductor including portions 108, 109, and 106 which are electrically connected to each other. The portions 108, 109, and 106 are cylindrical in the illustrated embodiments; however, other shapes are possible. The power divider-combiner 100 further includes an electrically and thermally conducting outer backplate 107 to which portion 106 of the main center conductor electrically and mechanically connects.

In the illustrated embodiments, the power divider-combiner 100 further includes a sidewall or exterior ground conductor 105. The output RF connectors 101 include ground conductors 120. The output RF connectors 101 are radially spaced apart relative to the portion 106. The ground conductors 120 of the output RF connectors 101 are mounted to the sidewall 105, and the center conductors 102 of the output RF connectors 101 pass through the sidewall 105. Further, the RF connector center conductors 102 define respective axes that are all perpendicular to an axis defined by the portion 106 of the main center conductor, in some embodiments. Other angles are possible, including in-line orientation of the RF output connectors out the back plate 107, rather than through the sidewall conductor 105.

The main center conductor portions 108, 109, 106, and the conductor 103 are substantially one-quarter an electrical wavelength long at the passband mid-band frequency $f_O$.

The power divider-combiner 100 further includes an inner flange or backplate 104 that is electrically and thermally conducting, in the illustrated embodiment. The conductor 103 has a respective inner end that is electrically and thermally connected to the flange 104.

The power divider-combiner 100 further includes exterior ground conductors 110 and 111. In various embodiments, the stepped diameter portions 108, 109, and 106 of the main center conductor, and the inner diameters of the exterior ground conductors 110, 111, and 104, and the conductor 103 define three unit element (quarter-wave) coaxial transmission lines. The outer diameter of the conductor 103 and the inner diameter of the ground conductor 105 and their connection to the flange 104 define a unit element (quarter-wave) transmission line shorted shunt stub. Referring to FIG. 1, the electrical short **104*a* is located at reference plane a-a, and the shorted shunt stub makes connection to the output connector center conductors 102** at reference plane b-b.

Figure 7:
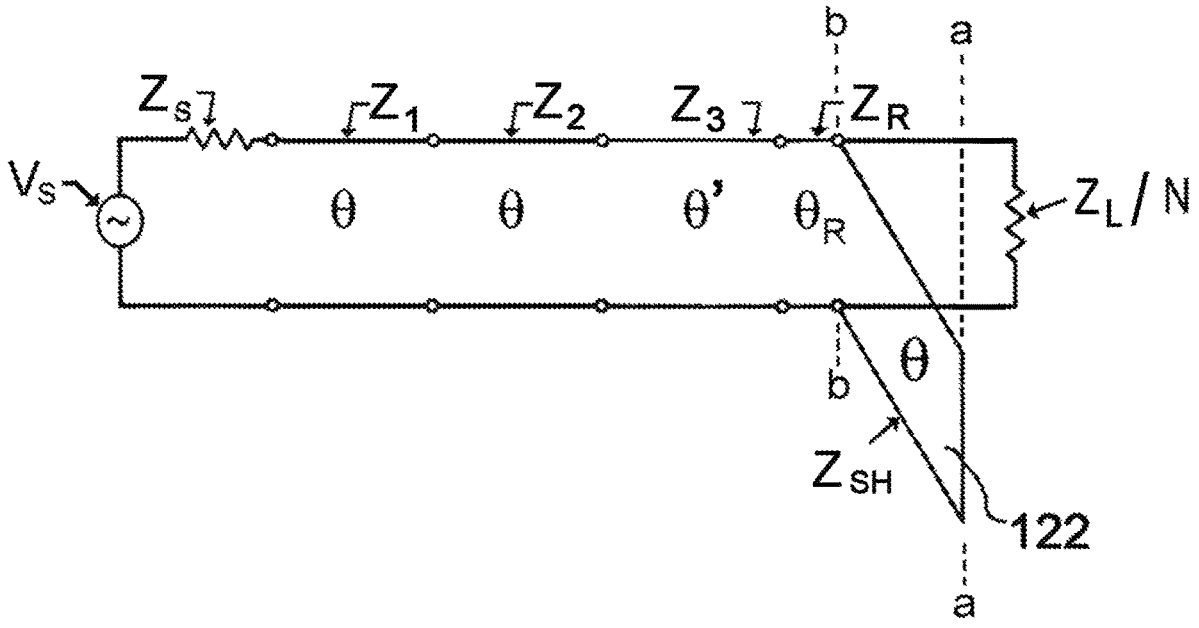
FIG. 7 is an equivalent circuit diagram for the divider/combiner shown in FIG. 1, when it is operated as a power divider.

Collectively, the three unit element transmission lines with characteristic impedances $Z_1$, $Z_2$, and $Z_3$ and the shorted shunt stub section with characteristic impedance $Z_{SH}$ are electrically modeled, in a generalized form, as a passband filter equivalent circuit shown in FIG. 7. A passband is a portion of the frequency spectrum that allows transmission of a signal with a desired minimum insertion loss by means of some filtering device. In other words, a passband filter passes a band of frequencies to a defined passband insertion loss vs. frequency profile. Desired filter passband performance is achieved by a two-step process:

1) Given a source impedance quantity $Z_S$, divider quantity (number of outputs) N, load impedance quantity $Z_L$ IN and desired passband a) bandwidth, and b) input port return loss peaks within the passband, calculate the unit element transmission line characteristic impedances $Z_1$, $Z_2$, $Z_3$ and unit element shorted shunt stub characteristic impedance value $Z_{SH}$. This may be accomplished, as one approach, using the design theory as described in M. C. Horton and R. J. Wenzel, "General theory and design of quarter-wave TEM filters," IEEE Trans. on Microwave Theory and Techniques, May 1965, pp. 316-327.

Figure 5:
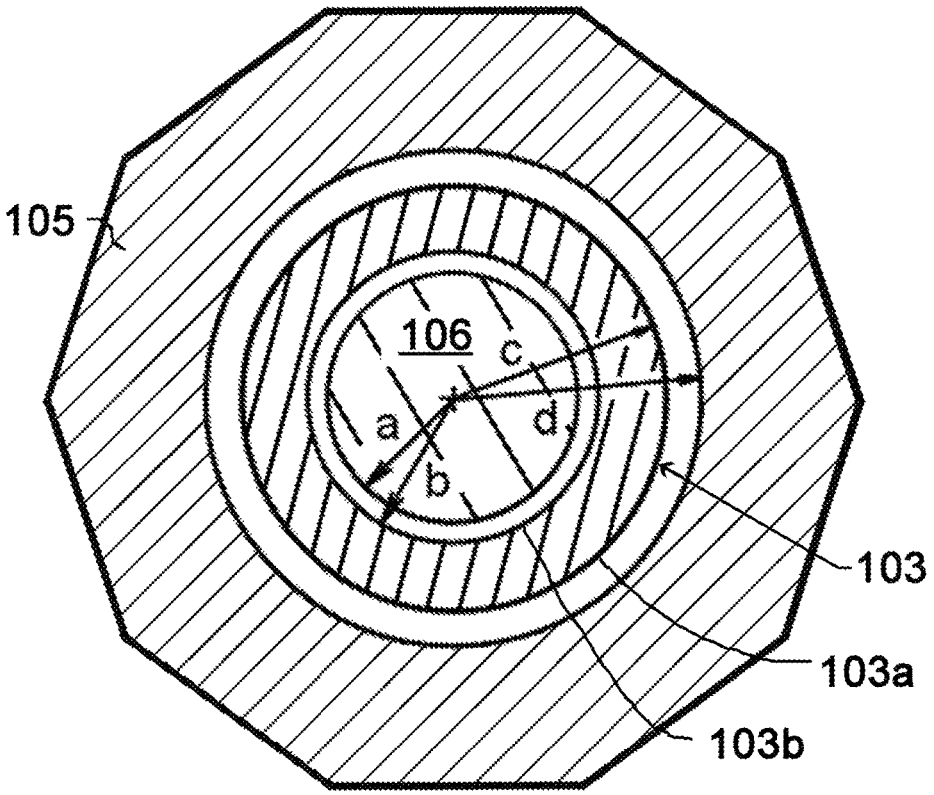
FIG. 5 is a sectional view taken along line 5-5 of FIG. 1.

2) After determining the above desired electrical transmission line characteristic impedances, then find corresponding diameters for the conductors 108, 109, and 106, and inner diameters of the ground conductors 110, 111, and 104 and of the conductor 103 which define unit element characteristic impedances $Z_1$, $Z_2$, and $Z_3$. In addition, the outer diameter of the conductor 103 and the inner diameter of ground conductor 105 define the shorted shunt stub unit element characteristic impedance $Z_{SH}$. For example (referring to cross-section FIG. 5), the characteristic impedance $Z_3$ is defined according to the formula $Z_3=60*\log_e(b/a)$ where quantity b is the radius of the inner surface of the conductor 103, and where quantity a is the radius of the outer surface of the main center conductor portion 106. Similarly, the characteristic impedance $Z_{SH}$ is defined according to the formula $Z_{SH}=60*\log_e(d/c)$ where quantity d is the radius of the inner surface of the ground conductor 105, and quantity c is the outer radius of the conductor 103. The above expressions for impedances $Z_3$ and $Z_{SH}$ assume air or vacuum dielectric, but other dielectric materials may be used along the lengths of unit element transmission lines corresponding to $Z_1$, $Z_2$, $Z_3$, and $Z_{SH}$, such as (but not limited to) Teflon, boron nitride, beryllium oxide, or diamond, for example.

Figure 8:
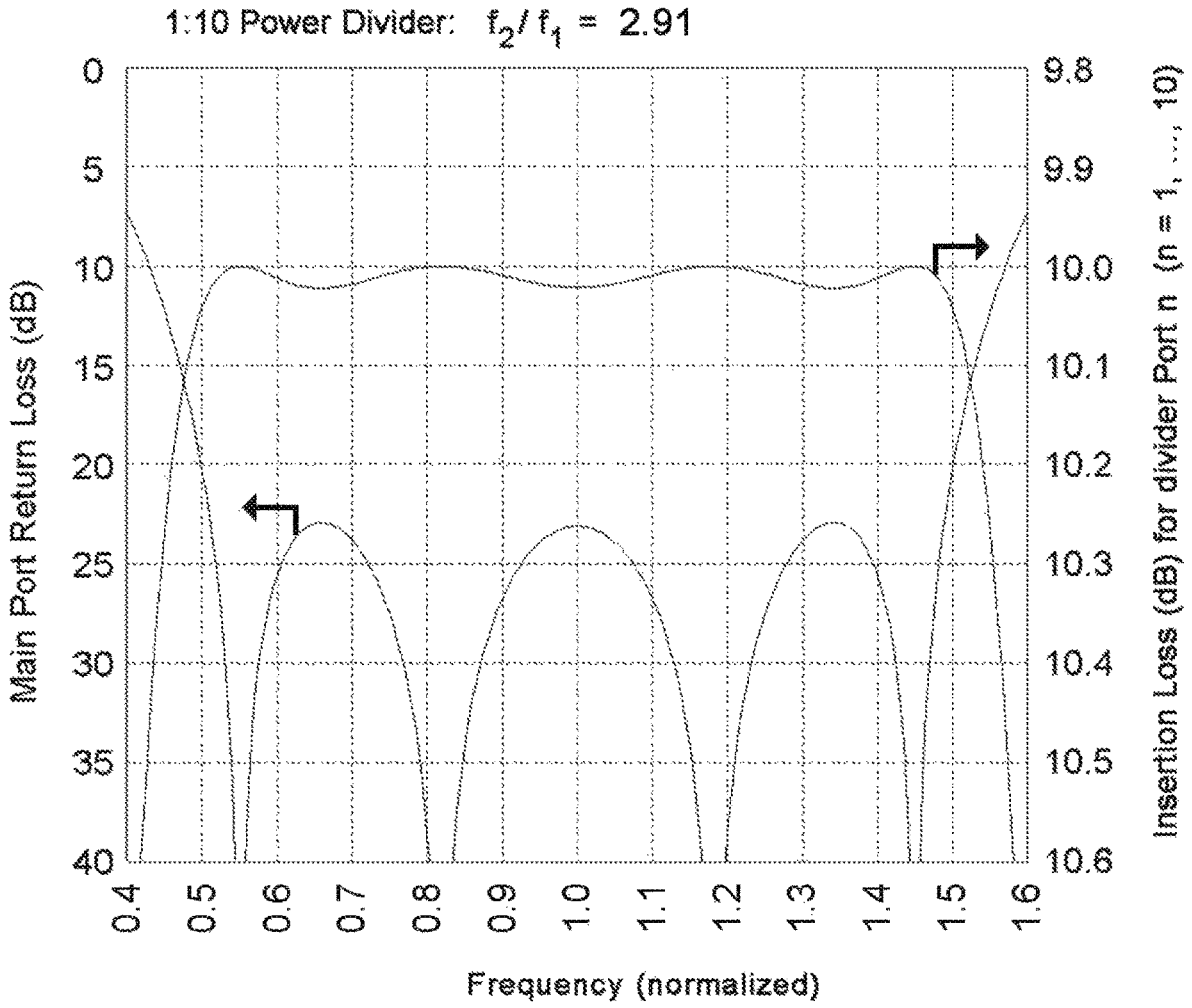
FIG. 8 is a graph showing typical input port return loss and output port insertion loss vs. frequency for embodiments of the divider/combiner of FIG. 1 that have one input port and ten output ports (when being used as a power divider).

As an example, given: N=10, $Z_S=Z_L=50$ ohms, 23 dB return loss peaks are desired for a bandwidth $F_2/F_1=2.91$, where $F_1$, $F_2$ represent the lower and upper edges of the passband, respectively. Using the Horton & Wenzel technique, unit element characteristic impedances $Z_1$, $Z_2$, $Z_3$ and the shorted shunt stub unit element characteristic impedance value $Z_{SH}$ were found. FIG. 8 shows calculated response using these derived characteristic impedances used in the equivalent circuit in FIG. 7. Cross-section dimensions throughout the filter device were then determined so as to achieve these unit element characteristic impedances. While the illustrated embodiments show three main conductor coaxial transmission lines between the source $V_S$ and reference plane b-b (referring to the equivalent circuit shown in FIG. 7), alternative embodiments built for lesser or broader bandwidth employ one or two (narrower bandwidth) or four or more main conductor coax unit elements (broader bandwidth).

Figure 9:
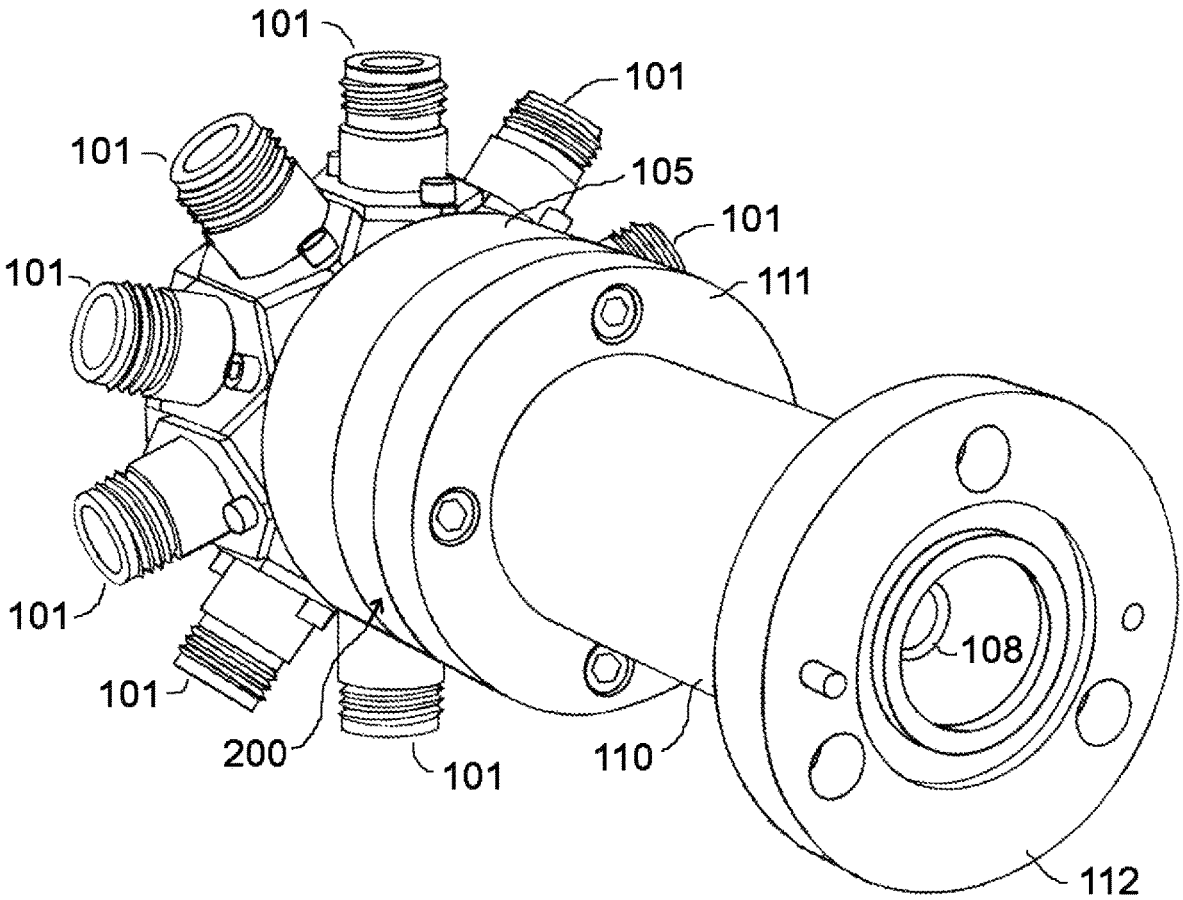
FIG. 9 is a perspective view showing embodiments of the combiner/divider of FIG. 1 that have an Electronic Industries Association (EIA) 7/8 flange main port, and ten Type N (female) connectors for the output ports (when being used as a power divider).
Figure 10:
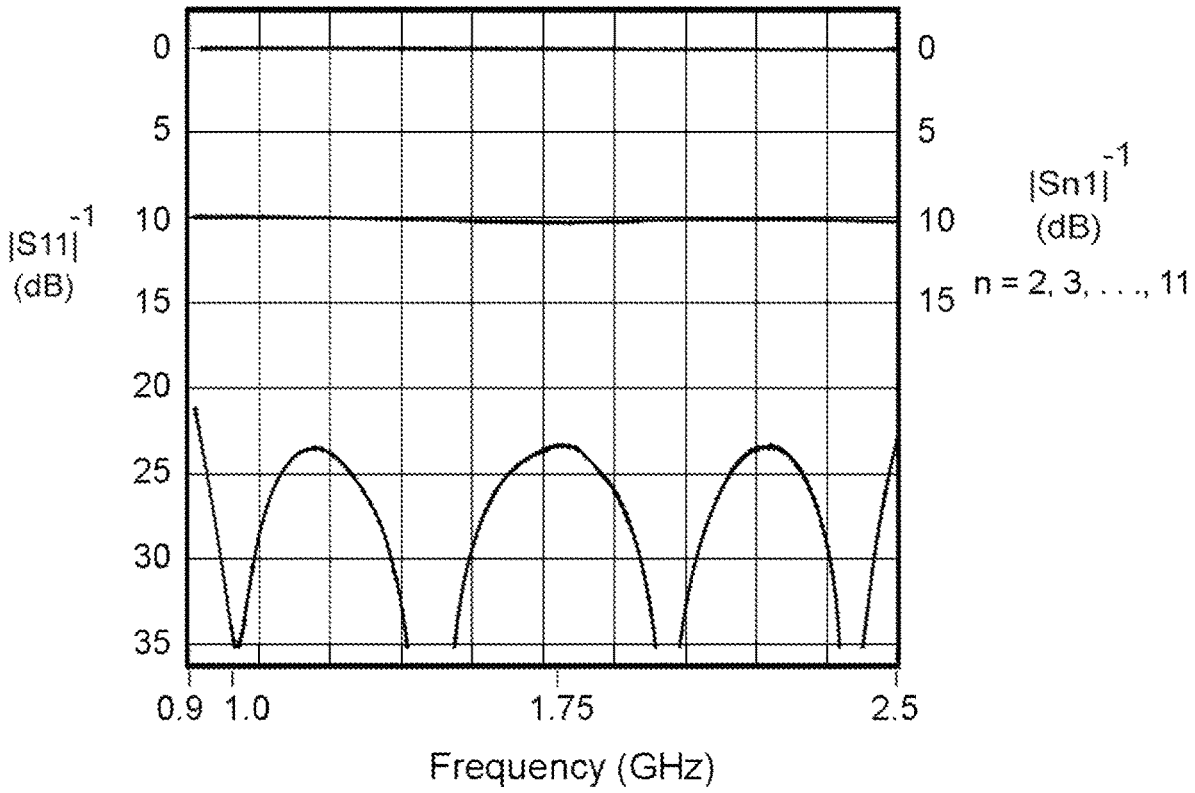
FIG. 10 shows measured RF performance of the divider/combiner of FIG. 9, in accordance with some embodiments, tested as a power divider.

FIG. 10 shows measured RF performance of the divider/combiner of FIG. 9. Tested as a power divider, measured RF performance shows good correlation with predicted main port return loss $|S_{11}|$ and typical output port insertion loss $|S_{n1}|$ vs. frequency.

Various conductive materials could be employed for the conductive components of the power divider-combiner 100. For example, in the illustrated embodiments, parts are fabricated from 6061 alloy aluminum. For corrosion resistance, some of these parts may be a) alodine coated, or b) electroless nickel flash-coated and MILspec gold plated. In other embodiments, parts are made of brass or magnesium alloy, also MILspec gold plated. Another possibility is MILspec silver plated, with rhodium flash coating to improve corrosion resistance.

FIG. 6 shows an exploded view of the power divider-combiner 100, in accordance with various embodiments.

The main stepped diameter center conductor, defined by the portions 108, 109, and 106, is fabricated as one piece, in the illustrated embodiments. It is bolted to the backplate 107 using a single ¼-20×¾" stainless steel cap screw SC3. Other size screws or other methods of attachment can be employed. The portions 108, 109 and 106 are the center conductors for three unit element coaxial transmission lines.

FIG. 11 shows a perspective view of a flange cylinder assembly 200 in accordance with various embodiments. In the illustrated embodiments, the flange cylinder assembly 200 includes the inner conducting flange 104 and the conductor 103. In the illustrated embodiments, the flange 104 and the conductor 103 are machined from a common piece. In alternative embodiments, the flange 104 and conductor 103 are separate pieces that are thermally and electrically connected together. The conductor 103 is bolted, soldered, or brazed, or press fit onto conducting flange 104 in alternative embodiments. The conductor 103 includes an outer conductive surface 103*a* that is cylindrical or generally cylindrical in the illustrated embodiments. The conductor 103 further includes an inner conductive surface 103*b* that is cylindrical or generally cylindrical in the illustrated embodiments. The flange cylinder assembly 200 includes a first end defined by the flange 104 and a second end 103*c*, defined by the conductor 103. The end 103*c* defines a radial line conductor surface. The flange 104 includes an alignment hub outer surface 104*b* and a short circuit conducting surface 104*a*. The outer surface 104*b* has an outer cylindrical surface having a diameter that is larger than the diameter of the outer cylindrical surface 103*a* of the conductor 103. The flange 104 also has an outer cylindrical surface having a diameter greater than the diameter of the surface 104*b*.

In the filter circuit synthesis technique as presented in the Horton & Wenzel reference, a desired circuit response (return loss over a passband as shown in FIG. 8, for example) results from the synthesis of transmission line characteristic impedances for a sequence of one or more unit element (substantially quarter-wave at the mid-band frequency $f_O$) transmission lines followed by a unit element shorted shunt stub transmission line connected in parallel with circuit load $Z_L/N$, as shown in FIG. 7 for this example.

Referring to FIGS. 1, 2 and the equivalent circuit shown in FIG. 7, the inner conductor 108 and the outer conductor 110 form a unit element (substantially quarter-wave) transmission line with characteristic impedance $Z_1$. The inner conductor 109, the inner surfaces of conductors 110, 111, and of flange 104 form a unit element transmission line with characteristic impedance $Z_2$. The inner conductor 106 and the inner surface 103*b* of the conductor 103 form a unit element transmission line with characteristic impedance $Z_3$, which has a unit element mid-band frequency phase length $\theta=\theta'+\theta_R$ where $\theta_R$ is the phase length of the radial transmission line 114 (FIGS. 3, 4) formed by the end 103*c* of the conductor 103 and the backplate conductor 107. 1) Electrical reference plane a-a (FIG. 7) corresponds to the physical reference plane a-a shown in FIG. 1, where the flange 104 conducting surface 104*a* in FIG. 11 serves as the short circuit for a unit element shorted shunt stub 122 (FIG. 7). 2) Electrical reference plane b-b (FIG. 7) corresponds to the physical reference plane b-b shown in FIG. 1, where the shorted shunt stub 122 (FIG. 7) connects in parallel with output termination impedance quantity $Z_L/N$. 3) Between reference planes a-a and b-b (FIG. 7) is a unit element with characteristic impedance $Z_{SH}$. The above described unit elements are substantially one-quarter wavelength long at the passband mid-band frequency $f_O$. One way of interpreting a quarter-wavelength transmission line (at the mid-band frequency $f_O$) is that it 'transforms' the wave admittance on a Smith Chart along a circle about the origin (where the reflection coefficient magnitude is zero) exactly 180 degrees.

In the illustrated embodiments, the quantity N of output RF connectors equals ten, and the corresponding quantity N of receiving bores 117 (FIGS. 3, 4, 6, and 11) in the conductor 103 equals ten. Other values of N=2, 3, . . . , 20 or more are possible. For example, a two-way divider-combiner has quantity N=2 equally spaced receiving bores 117 (and therefore N=2 output RF connectors).

In the illustrated embodiments, there are three coax unit elements having transmission line characteristic impedances $Z_1$, $Z_2$, and $Z_3$ (FIG. 7) with respective center conductor portions 108, 109, and 106 (FIG. 1) that precede the junction for the ten output connectors at physical reference plane b-b. However, for designs requiring less bandwidth, only one or two coax unit elements preceding the physical reference plane b-b may be used. Alternatively, four or more coax unit elements preceding physical reference plane b-b may be required for very broad-band designs requiring very low VSWR (voltage standing wave ratio) throughout the passband, as measured at the divider input port.

In various embodiments, the flange 112 and the conductor 110 are machined as one piece. Alternatively, the flange 112 and the conductor 110 may be separate pieces soldered, brazed, or bolted together. Bolted to the outer conductor 110 is the conductor 111, in the form of a flange, which may also be alternatively brazed or soldered instead of being bolted to the outer conductor 110. Using four stainless steel cap screws SC1 from behind (see FIG. 6), flange 111 sandwiches flange 104 to thread into four corresponding threaded holes in the back face (hidden from view) of outer conductor 105, in various embodiments. Other mechanical attachment methods can be employed.

In the illustrated embodiments, the overall structure may alternatively be constructed (excluding the ten output connectors 101 and their respective center conductors 102) using 3D printing, followed by plating with an electrically conducting material.

Divider output connectors 101 (FIGS. 1, 2, 6) are shown as flange mounted Type N (female) connectors. Each output connector (only one of ten connectors 101 is shown in FIG. 6) mounts to outer conductor 105 using two 4-40×3/16" cap screws SC4 (FIG. 6). Other Type N (female, or male) mounting types and other mechanical attachments can be employed. Other kinds of output RF connectors, such as TNC, SMA, SC, 7-16 DIN, 4.3-10 DIN male or female, and other EIA-type flanges can be employed.

In the illustrated embodiments, the stepped center conductor plus backplate 108, 109, 106, 107 assembly is bolted to the end interior of MTL ground conductor 105 by means of five 6-32×5/8" stainless steel cap screws SC2 (FIG. 6). Other mechanical attachment methods can be employed.

In various embodiments, the satellite conductors of the above-incorporated provisional patent application 62/140,390 are replaced by a solid conducting cylinder 103. This provides a superior thermal, electrical, and easier-to-fabricate design. Main port return loss, in some embodiments, is 23 dB or better over the frequency range 1.0 to 2.5 GHz, and divided power measures −10 dB at one of the ten output ports. This RF performance is substantially similar to that of the above-incorporated provisional patent application Ser. No. 62/140,390.

On the other hand, the satellite conductors approach of the provisional application does offer the advantage of a somewhat higher TE11 cutoff resonance frequency, compared to the cylinder approach, because the azimuthal surface currents for this TE11 mode are interrupted by the discretely separate satellite conductors. This is an undesirable mode resonance, and divider/combiner cross-section dimensions are therefore chosen, in the illustrated embodiments, so as to place this unwanted mode cutoff frequency above the operating frequency band (e.g., in some embodiments, above 2.5 GHz). Thus, there are advantages and disadvantages to each design.

In compliance with the patent statutes, the subject matter disclosed herein has been described in language more or less specific as to structural and methodical features. However, the scope of protection sought is to be limited only by the following claims, given their broadest possible interpretations. Such claims are not to be limited by the specific features shown and described above, as the description above only discloses example embodiments.

The invention claimed is:

1. A power divider/combiner comprising:

a main conductor defining an axis, and having a length along the axis, the main conductor having at least two different diameters along its length defining multiple portions;

an input connector having a center conductor, adapted to be coupled to a signal source, electrically coupled to the main conductor and having an axis coincident with the main conductor axis, and having a second conductor;

a cylinder conductor including an inner cylindrical surface radially exterior of and spaced apart from the main conductor, including an outer cylindrical surface, and having a cylinder axis coincident with the main conductor axis; and a plurality of output connectors, the output connectors having center conductors electrically coupled to the cylinder conductor and having respective second conductors.

2. A power divider/combiner in accordance with claim 1 and further comprising a first ground conductor radially exterior of the main conductor and electrically coupled to the second conductor of the input connector.

3. A power divider/combiner in accordance with claim 1 wherein the cylinder conductor is electrically about one-quarter wavelength long at a passband midband frequency.

4. A power divider/combiner in accordance with claim 1 and having a first end defined by the input connector and having a second end, the output connectors being proximate the second end, and further comprising an inner flange that is electrically and thermally conducting, between the first and second ends, radially exterior of the main conductor, and wherein the cylinder conductor has an end electrically coupled to the flange and wherein the outer cylindrical surface of the cylinder conductor is electrically coupled to the center conductors of the output connectors.

5. A power divider/combiner in accordance with claim 4 and further comprising an electrically and thermally conducting outer backplate at the second end electrically coupled to the main conductor and spaced apart from the cylinder conductor, in an axial direction, by a gap.

6. A power divider/combiner in accordance with claim 5 wherein a radial transmission line is defined between the outer backplate and the cylinder conductor.

7. A power divider/combiner in accordance with claim 4 and further comprising a first outer ground conductor radially exterior of the main conductor and connected to the second conductor of the input connector, and an outer sidewall ground conductor radially exterior of the cylinder conductor, spaced apart from the first outer ground conductor by the inner flange, and electrically coupled to the second conductors of the output connectors.

8. A power divider/combiner in accordance with claim 1 wherein the center conductor is stepped.

9. A power divider/combiner in accordance with claim 1 wherein there is an even number of the output connectors.

10. A power divider/combiner comprising:

a main conductor defining an axis, and having a length along the axis, the main conductor having multiple different diameters along its length defining multiple portions;

an input connector having a center conductor, adapted to be coupled to a signal source, electrically coupled to the main conductor and having an axis coincident with the main conductor axis, and having a second conductor, the input connector defining a first end of the divider/ combiner, the divider/combiner having a second end axially spaced apart from the first end;

a first ground conductor radially exterior of the main conductor and coupled to the second conductor of the input connector;

an electrically and thermally conducting inner flange, axially between the first ground conductor and the second end, radially exterior of the main conductor, and having an inner surface and a face surface;

an outer ground conductor axially between the inner flange and second end and having an inner surface;

a cylinder conductor, having the general shape of a hollow cylinder, having an inner cylindrical surface and outer cylindrical surface, radially exterior of and radially spaced apart from one of the portions of the main conductor, having a cylinder axis coincident with the main conductor axis, and having a proximal end electrically connected to the inner flange and a distal end extending towards the second end;

a plurality of output connectors having respective center conductors electrically coupled to the distal end of the cylinder conductor, via the outer cylindrical surface of the cylinder conductor, and having respective second conductors electrically coupled to the outer ground conductor;

the outer ground conductor having an inner surface radially exterior of the outer cylindrical surface of the cylinder conductor; and an electrically and thermally conducting outer backplate at the second end electrically coupled to the main conductor and axially spaced apart from the distal end of the cylinder conductor by a gap.

11. A power divider/combiner in accordance with claim 10 wherein the multiple portions of the main conductor comprise a first portion proximate the first end, a second portion having a diameter greater than the diameter of the first portion, adjacent the first portion and radially interior of the inner flange, and a third portion having a diameter greater than the diameter of the second portion, adjacent the second portion and radially interior of the cylinder conductor.

12. A power divider/combiner in accordance with claim 11 and comprising inner cylindrical surfaces, defined at least in part by the first ground conductor, inner flange, and cylinder conductor, radially exterior of and spaced apart from the multiple portions of the main conductor, wherein the inner cylindrical surfaces together with the multiple portions of the main conductor define multiple coaxial element transmission lines.

13. A power divider/combiner in accordance with claim 12 wherein the outer cylindrical surface of the cylinder conductor, the inner surface of the outer ground conductor, and the face surface of the inner flange define a unit element shorted shunt stub transmission line.

14. A power divider/combiner in accordance with claim 13 wherein the shorted shunt stub transmission line and the coaxial element transmission lines are electrically modeled to define a passband filter.

15. A method of manufacturing a power divider/combiner, the method comprising:

providing a main conductor defining an axis;

providing a coax input connector having a center conductor, adapted to be coupled to a signal source and having an axis coincident with the main conductor axis;

electrically coupling the input connector to the main conductor;

providing a hollow cylinder conductor radially exterior of and spaced apart from the main conductor, having a cylinder axis coincident with the main conductor axis, having an outer cylindrical surface;

providing a plurality of coax output connectors having respective center conductors;

providing an electrically and thermally conducting inner flange, radially exterior of the main conductor and having an inner surface and a face surface;

electrically coupling the respective center conductors of the output connectors to the hollow cylinder conductor; and defining a passband filter between the input connector and the output connectors.

16. A method in accordance with claim 15 wherein defining a passband filter comprises defining steps in the main conductor.

17. A method in accordance with claim 16 wherein the input connector includes an exterior conductor, wherein the output connectors include respective exterior conductors, and wherein the inner flange is provided axially between the first ground conductor and the output connectors.

18. A method in accordance with claim 17, the output connectors having respective exterior conductors, and the method further comprising providing a first ground conductor radially exterior of the main conductor; coupling the first ground conductor to the second conductor of the input connector; providing an outer ground conductor radially exterior of the hollow cylinder conductor and axially between the inner flange and the exterior conductors of the output connectors, the outer ground conductor having an inner surface; and electrically coupling the second ground conductor to the exterior conductors of the output connectors.

19. A method in accordance with claim 17 wherein defining a passband filter comprises defining a shorted shunt stub transmission line and a plurality of coaxial element transmission lines.

20. A method in accordance with claim 18 wherein defining a passband filter comprises defining a shorted shunt stub transmission line using wherein the outer cylindrical surface of the cylinder conductor, the inner surface of the outer ground conductor, and the face surface of the inner flange define a unit element shorted shunt stub transmission line.

* * * * *